US009842486B2

(12) United States Patent
Boisclair et al.

(10) Patent No.: US 9,842,486 B2
(45) **Date of Patent: *Dec. 12, 2017**

(54) USER INTERFACE CONFIGURATION FOR ALARM SYSTEMS

(71) Applicant: Tyco Fire & Security GmbH, Neuhausen am Rheinfall (CH)

(72) Inventors: J. R. Mario Boisclair, Montreal (CA); Joseph Piccolo, III, Fitzwilliam, NH (US); Dennis A. McEvoy, Groton, MA (US); Mary Winna Fox, Nashville, TN (US); Kirill Alexandrov, Longueuil (CA)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 106 days.

This patent is subject to a terminal disclaimer.

(21) Appl. No.: 14/095,172

(22) Filed: Dec. 3, 2013

(65) Prior Publication Data

US 2015/0154855 A1 Jun. 4, 2015

(51) Int. Cl.
*G08B 25/14* (2006.01)
*G08B 29/18* (2006.01)

(52) U.S. Cl.
CPC ..... *G08B 25/14* (2013.01); *G08B 29/18* (2013.01)

(58) Field of Classification Search
CPC ..... G06F 15/16; G06F 9/547; G06F 11/0709; G06F 11/0769; G06F 11/0727; G06F 11/0748; G06F 11/0775
USPC ..... 340/506; 709/226, 220, 221, 222, 225, 709/223, 217, 229, 202; 370/352, 389; 707/E17.117, E17.107; 714/E11.179, 714/47.1
See application file for complete search history.

(56) References Cited

U.S. PATENT DOCUMENTS 5,325,518 A * 6/1994 Bianchini, Jr. ..... G06F 11/22 714/31
5,394,522 A * 2/1995 Sanchez-Frank . G06F 17/30289 707/E17.032
5,894,566 A * 4/1999 Croslin ..... H04L 41/065 703/21

(Continued)

FOREIGN PATENT DOCUMENTS

WO 2006/040245 A1 4/2006

*Primary Examiner* — Fekadeselassie Girma

(57) ABSTRACT

System and method for establishing configuration parameters for a comprehensive user interface of an alarm system. An exemplary embodiment of a configuration system in accordance with the present disclosure includes a plurality of alarm system workstations, each alarm system workstation having a set of configuration parameters associated therewith, a client workstation, and a user interface broker operatively connected to each of the alarm system workstations and the client workstation, wherein the user interface broker is configured to aggregate data from the alarm system workstations and to present such aggregated data at the client workstation using the comprehensive user interface. The user interface broker is further configured to facilitate designation of one of the alarm system workstations as a main workstation, whereupon the configuration parameters of the designated main workstation are applied to the comprehensive user interface.

18 Claims, 8 Drawing Sheets

(56) References Cited

U.S. PATENT DOCUMENTS 6,084,168 A * 7/2000 Sitrick ..... G09B 15/023 84/477 R
6,125,390 A * 9/2000 Touboul ..... G06F 11/0709 709/223
6,452,924 B1 * 9/2002 Golden ..... H04Q 11/0478 370/254
6,658,465 B1 * 12/2003 Touboul ..... G06F 11/327 709/220
6,704,873 B1 * 3/2004 Underwood ..... H04L 63/02 709/223
6,901,440 B1 * 5/2005 Bimm ..... H04L 41/5051 370/352
7,015,945 B1 * 3/2006 Sullivan ..... G08B 13/19671 348/150
7,031,442 B1 * 4/2006 Neyman ..... H04M 1/2473 379/265.01
7,200,651 B1 * 4/2007 Niemi ..... G06F 8/65 709/223
7,227,450 B2 * 6/2007 Garvy ..... G08B 29/14 340/286.05
7,272,815 B1 * 9/2007 Eldridge ..... G06F 8/71 707/999.009
7,472,422 B1 * 12/2008 Agbabian ..... H04L 41/06 726/25
7,778,717 B2 * 8/2010 Bachman ..... G05B 19/41865 700/83
7,840,285 B2 * 11/2010 Wilson ..... G05B 19/042 700/1
8,723,665 B2 * 5/2014 Foisy ..... G08B 13/1672 340/506
9,076,319 B2 * 7/2015 Boisclair ..... G08B 25/14
9,210,560 B2 * 12/2015 Regan ..... H04M 1/72525
9,384,656 B2 * 7/2016 Patterson ..... G08B 29/185
2002/0054587 A1 * 5/2002 Baker ..... G06F 11/0709 370/352
2003/0093563 A1 * 5/2003 Young ..... H04L 12/4633 709/245
2003/0100965 A1 * 5/2003 Sitrick ..... G09B 15/023 700/83
2004/0172222 A1 * 9/2004 Simpson ..... G06F 19/3418 702/189
2005/0081119 A1 * 4/2005 DiZoglio ..... G06F 11/0727 714/47.1
2005/0086298 A1 * 4/2005 Campbell ..... G06Q 40/00 709/203
2005/0190055 A1 * 9/2005 Petite ..... G01V 1/364 340/531
2007/0194906 A1 * 8/2007 Sink ..... G08B 17/10 340/506
2008/0048851 A1 * 2/2008 Reyes ..... G08B 7/06 340/506
2008/0079560 A1 * 4/2008 Hall ..... G05B 19/41865 340/506
2009/0199299 A1 * 8/2009 McKinnon ..... G06F 21/10 726/26
2009/0293107 A1 * 11/2009 Campbell ..... G06Q 30/04 726/5
2009/0319247 A1 * 12/2009 Ratcliffe, III ..... G09B 19/0053 703/13
2010/0211662 A1 * 8/2010 Glendinning ..... H04L 41/0843 709/223
2010/0226494 A1 * 9/2010 Lynch ..... H04N 7/24 380/28
2011/0254681 A1 * 10/2011 Perkinson ..... G08B 25/14 340/506
2012/0050069 A1 * 3/2012 Mercier ..... G07C 9/00103 340/932.2
2012/0191439 A1 * 7/2012 Meagher ..... G06F 17/5009 703/18
2012/0259436 A1 * 10/2012 Resurreccion ..... G05B 23/0216 700/17
2012/0310383 A1 * 12/2012 Karaffa ..... G05B 19/41865 700/80
2013/0132461 A1 * 5/2013 Patel ..... G06F 9/547 709/202
2014/0046645 A1 * 2/2014 White ..... G06F 17/509 703/13
2014/0145855 A1 * 5/2014 Boisclair ..... G08B 25/14 340/691.8
2014/0297802 A1 * 10/2014 Liang ..... G08B 25/005 709/217
2014/0331796 A1 * 11/2014 Lee ..... G01N 33/02 73/866

* cited by examiner

USER INTERFACE CONFIGURATION FOR ALARM SYSTEMS

FIELD OF THE DISCLOSURE

The disclosure relates generally to the field of alarm systems, and more particularly to a system and method for establishing interface parameters for a comprehensive user interface for an alarm system.

BACKGROUND OF THE DISCLOSURE

Alarm systems, such as fire alarm and security systems, typically include one or more centralized alarm panels that receive information from various sensors that are distributed throughout a structure or area. For example, a typical fire alarm system may include a plurality of initiating devices (e.g. smoke detectors, manually-actuated pull stations, etc.) that are connected to one or more alarm panels. During normal operation of the alarm system, the alarm panel may monitor electrical signals associated with each of the initiating devices for variations that may represent the occurrence of an alarm condition. For example, a variation in a particular electrical signal may represent the detection of smoke by a smoke detector in a corresponding area, or "zone," of a building in which the smoke detector is located, and may cause the alarm panel to enter an alarm mode. The alarm panel may be configured to respond to such a condition by initiating certain predefined actions, such as activating one or more notification appliances (e.g. strobes, sirens, public announcement systems, etc.) within the monitored building.

An alarm system may also include a workstation, such as a personal computer (PC) or server, which is operatively connected to the alarm panel of the alarm system. If the alarm system includes a plurality of alarm panels, the panels may be networked, such as in a ring configuration, and the workstation may be connected to the network as a network node, for example. The workstation may be loaded with one or more software applications that provide human operators of the system with a user interface (UI) for monitoring and controlling certain aspects of the alarm system. For example, a UI may provide an operator with a graphical representation of the alarm system, including all of the individual initiating devices and notification appliances (collectively referred to as "points") within the system. The UI may allow an operator to observe the functional status of the points, and may further allow the operator to activate, deactivate, or otherwise exert control over the operation of the points. For example, the UI may allow an operator to readily determine whether a particular point in the system is functioning properly, and to dispatch service personnel if it is not. The UI may further allow an operator to determine the specific initiating device or devices that were tripped upon the occurrence of an alarm condition. Still further, the UI may allow an operator to manually activate one or more specified notification appliances within the system, such as for delivering a public announcement.

It is typical for alarm systems that are implemented in large-scale applications to include a plurality of independent alarm system workstations, each having an independent UI for facilitating control and monitoring of a plurality of respective points. In order to provide operators with a single, unified UI for such a plurality of workstations, point data from each of the independent UIs may be transmitted to a single workstation or software program—referred to as a "UI broker"—which may aggregate the point data and present it to a client in a single, comprehensive interface. However, it is possible that two or more of the independent UIs from which point data is aggregated may be configured with different and potentially conflicting interface parameters. For example, a first UI may be configured with a first set of operational parameters that dictate certain colors, images, controls, notification sounds, etc., that may be presented to a client to facilitate control and monitoring of particular system points, while a second UI may be configured with a second set of operational parameters that include colors, images, controls, notification sounds, etc. that are different from those of the first set. These differences must be reconciled upon the aggregation and presentation of point data via the UI broker.

SUMMARY

In view of the forgoing, a system and method for establishing configuration parameters for a comprehensive user interface of an alarm system are provided herein.

An exemplary embodiment of a configuration system in accordance with the present disclosure may include a plurality of alarm system workstations, each alarm system workstation having a set of configuration parameters associated therewith, a client workstation, and a user interface broker operatively connected to each of the alarm system workstations and the client workstation, wherein the user interface broker is configured to aggregate data from the alarm system workstations and to present such aggregated data at the client workstation using the comprehensive user interface. The user interface broker may be configured to facilitate designation of one of the alarm system workstations as a main workstation, whereupon the configuration parameters of the designated main workstation may be applied to the comprehensive user interface.

An exemplary method for establishing configuration parameters for a comprehensive user interface of an alarm system in accordance with the present disclosure may thus include designating one of a plurality of alarm system workstations as a main workstation, and applying configuration parameters associated with the designated main workstation to the comprehensive user interface.

An exemplary alternative embodiment of a configuration system for a comprehensive user interface of an alarm system in accordance with the present disclosure may include a plurality of alarm system workstations, each alarm system workstation having a configuration add-on configured to facilitate selection of one or more categories of configuration parameters for possible application to the comprehensive user interface. The configuration system may further include a user interface broker operatively connected to each of the alarm system workstations, and a client workstation operatively connected to the user interface broker. The user interface broker may be configured to aggregate data from the alarm system workstations and to present such aggregated data at the client workstation using the comprehensive user interface. The user interface broker may be further configured to facilitate specification of an ordered sequence of the alarm system workstations, wherein the ordered sequence is used by the user interface broker to determine which of the configuration parameter categories selected in the configuration add-ons of the alarm system workstations may be applied to the comprehensive user interface.

An exemplary alternative method for establishing configuration parameters for a comprehensive user interface of an alarm system in accordance with the present disclosure may thus include selecting categories of configuration parameters at each of a plurality of alarm system workstations for possible application to the comprehensive user interface, specifying an ordered sequence of the alarm system workstations, and using the ordered sequence of alarm system workstations to determine which of the selected configuration parameter categories may be applied to the comprehensive user interface.

BRIEF DESCRIPTION OF THE DRAWINGS

By way of example, specific embodiments of the disclosed device will now be described, with reference to the accompanying drawings, in which.

DETAILED DESCRIPTION

Figure 1:
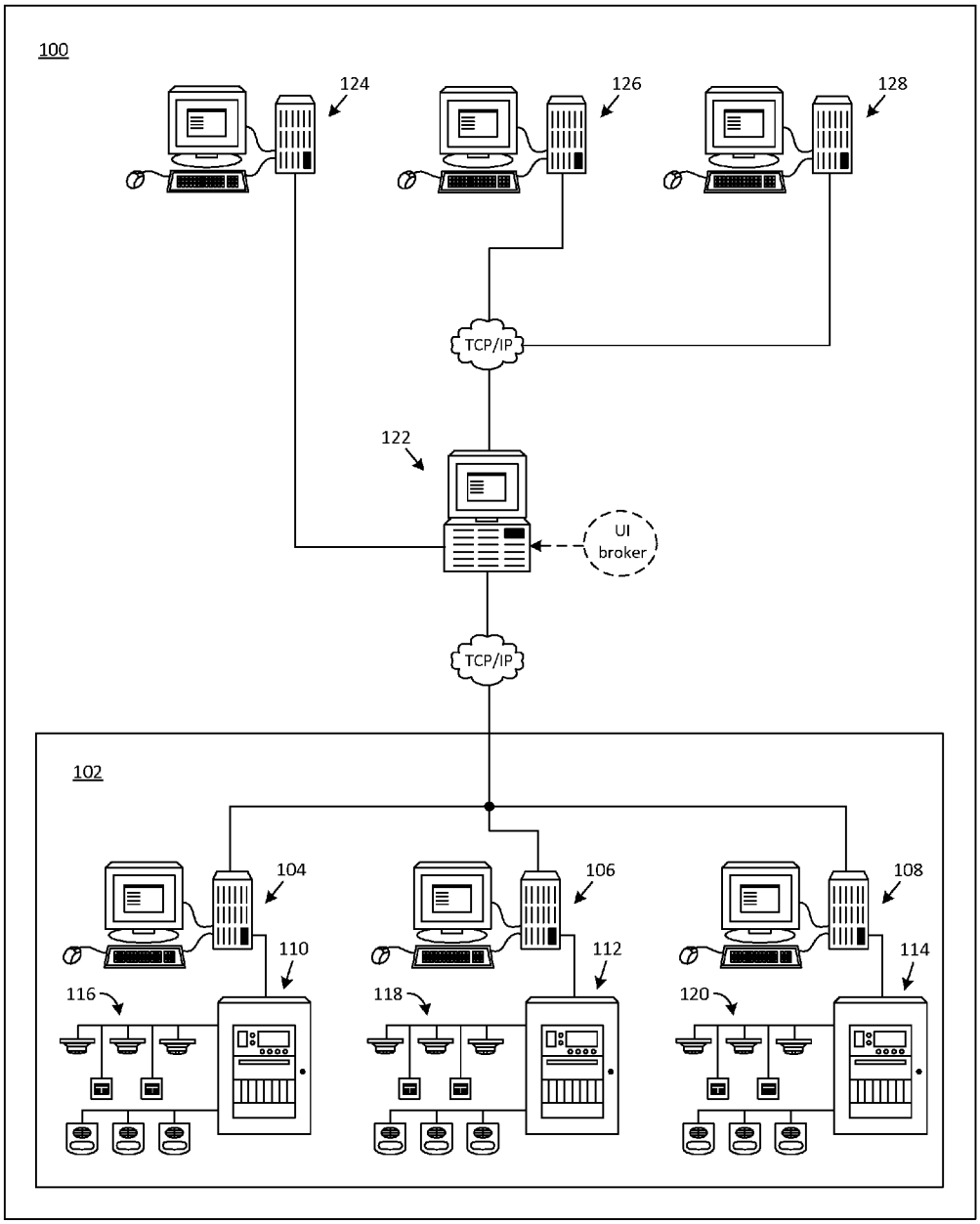
FIG. 1 is a schematic diagram illustrating an exemplary configuration system in accordance with the present disclosure.

A system and method for establishing user interface parameters for an alarm system will now be described more fully hereinafter with reference to the accompanying drawings, in which preferred embodiments of the disclosure are shown. This disclosed system and method, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

It will be appreciated by those of ordinary skill in the art that the system and method described herein may be implemented in virtually any type of alarm or monitoring system, including, but not limited to, fire alarm systems, burglar alarm systems, surveillance systems, air quality monitoring systems, inventory monitoring systems, etc., or any combination thereof, such as may be provided for detecting an alarm event (e.g., a security breach) or a warning condition (e.g., an elevated temperature) in a building, structure, enclosure, or area (collectively referred to herein as "sites"). Many other applications are contemplated and may be implemented without departing from the scope of the present disclosure. All such applications are collectively referred to herein as "alarm systems."

A first exemplary configuration system 100 in accordance with the present disclosure is depicted in FIG. 1. The configuration system 100 may include an alarm system 102 installed at a monitored site. The alarm system 102 may include a plurality of alarm system workstations 104, 106, and 108, such as personal computers (PCs) or servers, which are each loaded with a user interface (UI) software application. Each of the alarm system workstations 104-108 may be operatively connected to one or more respective alarm panels 110, 112, and 114, and each of the alarm panels 110-114 may in turn be operatively connected to a respective plurality of system points 116, 118, and 120 (e.g., initiating devices and notification appliances) that are distributed throughout the monitored site. Thus, each of the alarm panels 110-114 shown in FIG. 1 may represent a plurality of interconnected alarm panels, and each of the points 116-120 shown in FIG. 1 may represent a plurality of interconnected points. Configured thusly, each UI application on a respective alarm system workstation 104-108 may provide a separate, independent UI for a respective plurality of points 116-120 in the system 102. For example, in one non-limiting embodiment the UI applications on each of the workstations 104-108 may be connected to as many as 50,000 points. The point capacity of the entire exemplary alarm system 102, including each of the three independent alarm system workstations 104-108 shown in FIG. 1, may therefore be 150,000 points, though this number is not limiting.

The configuration system 100 may further include a software application or module referred to herein as a "UI broker." The UI broker may be installed on a broker workstation 122 (such installation represented by the dashed bubble and arrow shown in FIG. 1) that is directly or indirectly connected to each of the alarm system workstations 104-108 via a wired or wireless network connection, such as via the Internet using transmission control protocol and Internet protocol (TCP/IP) as shown in FIG. 1. Various other network connection arrangements are contemplated, including, but not limited to, dial-up, Ethernet, token ring, etc., and may be additionally or alternatively implemented without departing from the scope of the present disclosure. The network connection is in some embodiments a secure connection, such as may be achieved through the implementation of a virtual private network (VPN) or other secure connection technology. The broker workstation 122 may be located in any of a variety of locations, such as at the monitored site, at the location of one of the client workstations 124-128 (described below), or elsewhere.

Generally, the UI broker may be an architectural pattern for UI data validation, UI data transformation, and UI data routing. The UI broker may mediate communication amongst UI applications, minimizing the mutual awareness that applications have of each other in order to be able to exchange UI data, effectively implementing decoupling. The general purpose of the UI broker is to take incoming UI data from UI applications and perform some action on them. For example, the UI broker may perform some or all of the following actions: route UI data to one or more of many destinations; transform UI data into an alternative representation; perform UI data aggregation; decompose UI data into multiple data packets and send them to appropriate destinations, then recompose the data into a single packet to return to a user; interact with an external repository to augment UI data or store it; invoke Web services to retrieve data; and respond to events or errors.

In the present example, the UI broker may be an interface application that is configured to receive and aggregate interface data provided by each of the UI applications residing on the respective workstations 104-108 in the alarm system 102. Particularly, the UI broker may be configured to receive status information pertaining to each of the points 116-120 in the entire alarm system 102, such data being provided by each individual UI application, and may further be configured to issue command and control instructions to each of the UI applications in response to operator input. In one non-limiting exemplary embodiment, the UI broker may be the same or similar to that disclosed in U.S. patent application Ser. No. 13/688,441, titled "User Interface Broker for Fire Alarm Systems," the entirety of which application is incorporated by reference herein.

The configuration system 100 may further include one or more client workstations 124-128 (e.g. PCs or servers) that may be directly or indirectly connected to the broker workstation 122 via a secure, wired or wireless network connection. Such connections may be "permanent," as in the case of a client server that may be continuously connected to the broker workstation 122 from a fixed location, or "transient," as in the case of a client laptop that may intermittently connect to the broker workstation 122 from various locations. When connected to the broker workstation 122, the client workstations 124-128 may be provided with access to the UI broker residing thereon. The client workstations 122 may be loaded with software applications and/or authentication arrangements (e.g., digital certificates) to facilitate secure connection and access to the UI broker.

The UI broker may provide each of the connected client workstations 124-128 with a UI that facilitates access to all of the points 116-120 in the entire alarm system 102 as aggregated by the UI broker. Particularly, the UI broker may aggregate point configuration data provided by the UI applications residing on each of the alarm system workstations 104-108 connected thereto into a single data file that is sent to each of the client workstations 124-128. Thus, from the point of view of a human user, each client workstation 124-128 appears to be connected to a single, large, "virtual" alarm system workstation to which all of the points 116-120 in the system 102 are connected. In addition, the UI broker may route global and point specific messages (e.g. command and control signals) from each client workstation 124-128 to appropriate alarm system workstations 104-108 for allowing users to access and exert control over specified points in the alarm system 102. Still further, the UI broker may monitor its connections to the various alarm system workstations 104-108 and may report any faults or connection issues to the client workstations 124-128 for display to users. Each of the client workstations 124-128 may thereby provide users with a single, comprehensive interface that facilitates observation of, and control over, all of the points 116-120 in the alarm system 102 in a seamless, unified manner.

Each of the UI applications residing on the respective workstations 104-108 may include a configuration tool (e.g., a software component of the UI application) that allows a user to designate parameters that control certain aspects of the appearance and operation of each respective UI application. Such parameters may include, but are not limited to, notification sounds, time and date, colors and images associated with certain items and system conditions, the order and general configuration of particular screens that may be displayed, and particular control buttons and menus that may be presented for monitoring and controlling the operation of respective points 116-120. Each UI application may thus be tailored to suit the preferences of a particular operator or operator(s), and/or to suit a particular point or group of points within the alarm system 102 to which a respective one of the alarm system workstations 104-108 is connected.

It is possible, and perhaps typical, for two or more of the UI applications residing on the alarm system workstations 104-108 to be configured with different and potentially conflicting parameters. For example, the UI application residing on the alarm system workstation 104 may be configured to provide a first set of control options (e.g., soft menus and/or buttons), while the UI application residing on the alarm system workstation 106 may be configured to provide a second set of control options that is different from the first set. Such differences in configuration may be attributable, in one non-limiting example, to the UI applications being configured by different operators in different buildings in which the alarm system workstations 104 and 106 are located.

In view of the foregoing, it may be desirable to reconcile differences among the configuration parameters of the various UI applications in the alarm system 102 when data from the UI applications are aggregated by the UI broker and presented at the client workstations 124-128. Particularly, it may be desirable to specify which of the configuration parameters from the various UI applications should be applied to the aggregated, comprehensive UI that is ultimately presented to clients.

In order to facilitate the selection of a single set of configuration parameters for application to the comprehensive UI, the UI broker may be provided with a configuration tool (e.g., a software component of the UI broker) that is configured to allow an operator to designate one of the alarm system workstations 104-108 as a "main" workstation. Designating one of the alarm system workstations 104-108 thusly may result in all of the configuration parameters of the designated main workstation to be propagated to the comprehensive UI that is presented at the client workstations 124-128, regardless of any differences between the configuration parameters of the UI application of the designated main workstation and the configuration parameters of the other alarm system workstations in the alarm system 120. Thus, control and/or supervisory data relating to all of the points 116-120 of the alarm system 102 may be presented to clients via the UI broker using the established configuration settings of the designated main workstation.

Figure 2:
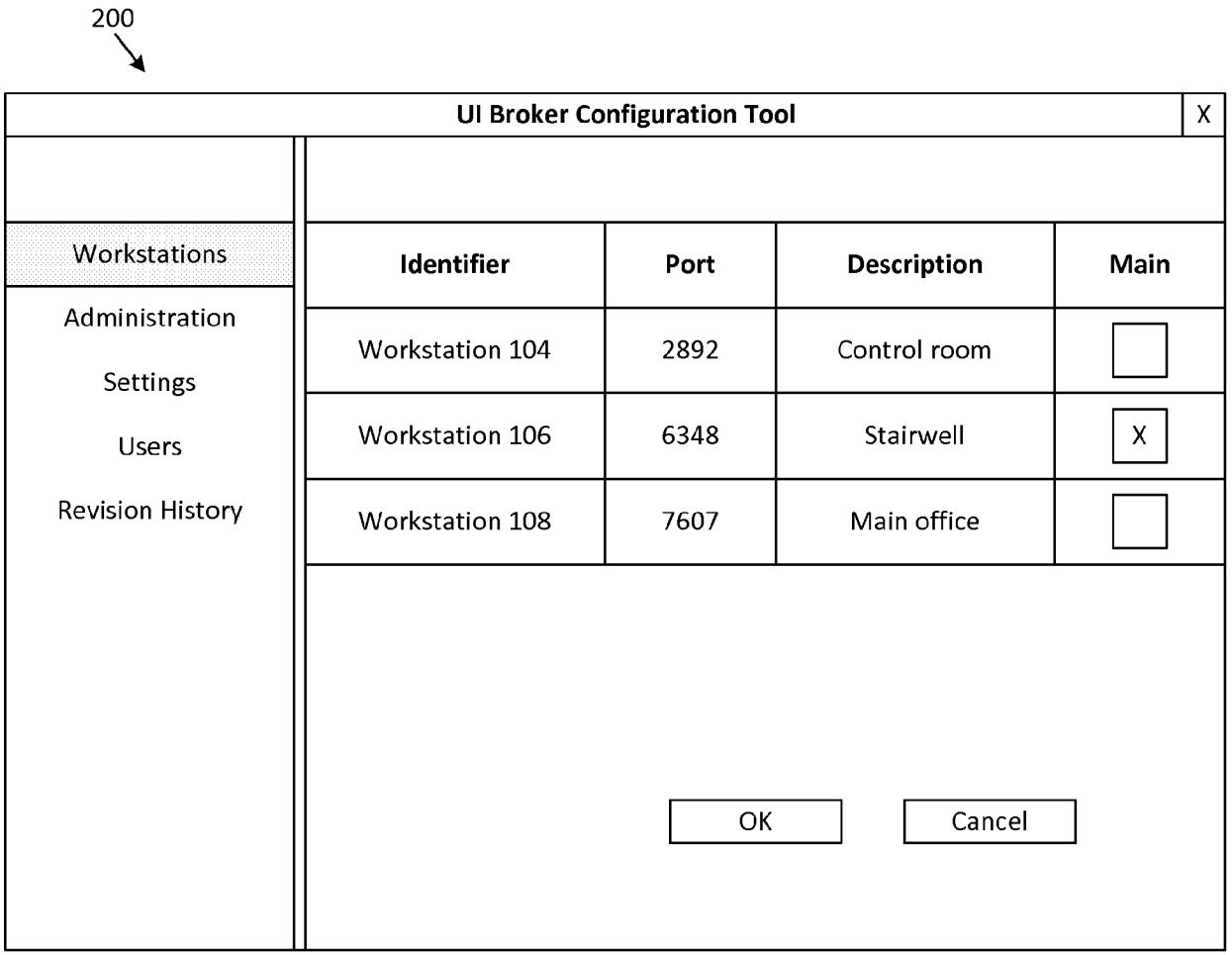
FIG. 2 is a screen shot illustrating an exemplary configuration tool for a UI broker in accordance with the present disclosure.

A screenshot of an exemplary configuration tool 200 of the UI broker of the alarm system 102 is shown in FIG. 2. The configuration tool 200 may include a list of the alarm system workstations 104-108 in the alarm system 102 that have been selected for interface via the UI broker. Such list may have been automatically or manually established upon previous initialization of the UI broker and may include some or all of the alarm system workstations 104-108 in the alarm system 102. The configuration tool 200 may further be configured to enable an operator to designate one of the listed alarm system workstations 104-108 as a "main" workstation. For example, a clickable box or field may be provided adjacent each of the listed alarm system workstations 104-108 as shown in FIG. 2. In another example, the first alarm system workstation in the list may be designated as a "main" workstation. Of course, those of ordinary skill in the art will appreciate that many other selection methods, including but not limited to, pull-down menus, numerical-entry fields, etc., may alternatively be implemented for facilitating designation of one of the alarm system workstations 104-108 as the main workstation.

Upon designating one of the listed alarm system workstations 104-108 as the main workstation in the configuration tool 200 (alarm system workstation 106 is designated as the main workstation in FIG. 2), the configuration parameters of the UI application of the designated main workstation may be implemented by the UI broker as described above. Establishing the configuration parameters of the UI broker in this manner represents a significant convenience and time savings for an operator of the UI broker, since the operator is only required to make a single selection (i.e., to select a main workstation) instead of being required to individually select all of the configuration parameters of the comprehensive UI that is presented at the client workstations 124-128.

Figure 3:
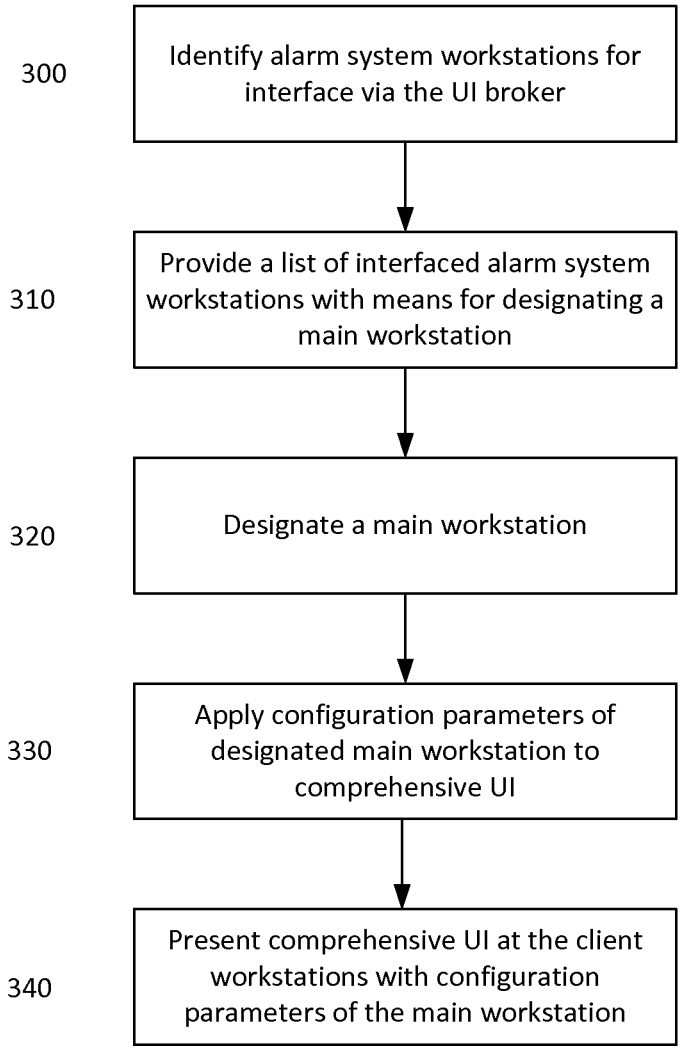
FIG. 3 is a flow diagram illustrating an exemplary method for establishing configuration parameters for a comprehensive UI in accordance with the present disclosure.

Referring to FIG. 3, a flow diagram illustrating an exemplary method for implementing a configuration system in accordance with the present disclosure is shown. Such method will now be described in conjunction with the schematic representation of the alarm system 102 shown in FIG. 1 and the exemplary screenshot of the configuration tool 200 shown in FIG. 2.

At a first step 300 of the exemplary configuration method, an operator may use the configuration tool 200 to identify two or more of the alarm system workstations 104-108 in the alarm system 102 that will be made available for client interface via the UI broker. Such identification may be performed by inputting a computer identifier, TCP/IP port, and/or connection passcode for each desired alarm system workstation, for example.

At step 310, the operator may open the configuration tool 200 of the UI broker, whereupon the operator may be presented with the list of previously-entered, interfaced alarm system workstations 104-108, along with an arrangement for designating one of the listed alarm system workstations 104-108 as a main workstation. The operator may, at step 320, use the provided designation means to designate one of the listed alarm system workstations 104-108 as the "main" workstation. For example, the operator may click an appropriately-labeled box or field located adjacent one of the listed alarm system workstations 104-108 as described above.

At step 330, the UI broker may ascertain the configuration parameters of the UI application of the designated main workstation, and may apply those configuration parameters to the comprehensive UI that will be presented at the client workstations 124-128 via the UI broker. At step 340 the UI broker may present the comprehensive UI to clients at the client workstations 124-128, whereby clients may interface with the points 116-120 of the alarm system 102 via a UI that is configured with parameters that are substantially the same as those of the designated main workstation.

In an alternative embodiment of the configuration system and corresponding method of the present disclosure, it is contemplated that different alarm system workstations may be designated for controlling different configuration parameters of the comprehensive UI that is presented at the client workstations 124-128. For example, an operator of the UI broker of the alarm system 102 may prefer the color and image parameters of the UI application of the alarm system workstation 104 over the color and image parameters of the UI applications of the alarm system workstations 106 and 108, but may prefer the notification sound parameters of the UI application of the alarm system workstation 108 over the notification sound parameters of the UI applications of the alarm system workstations 104 and 106.

Figure 4:
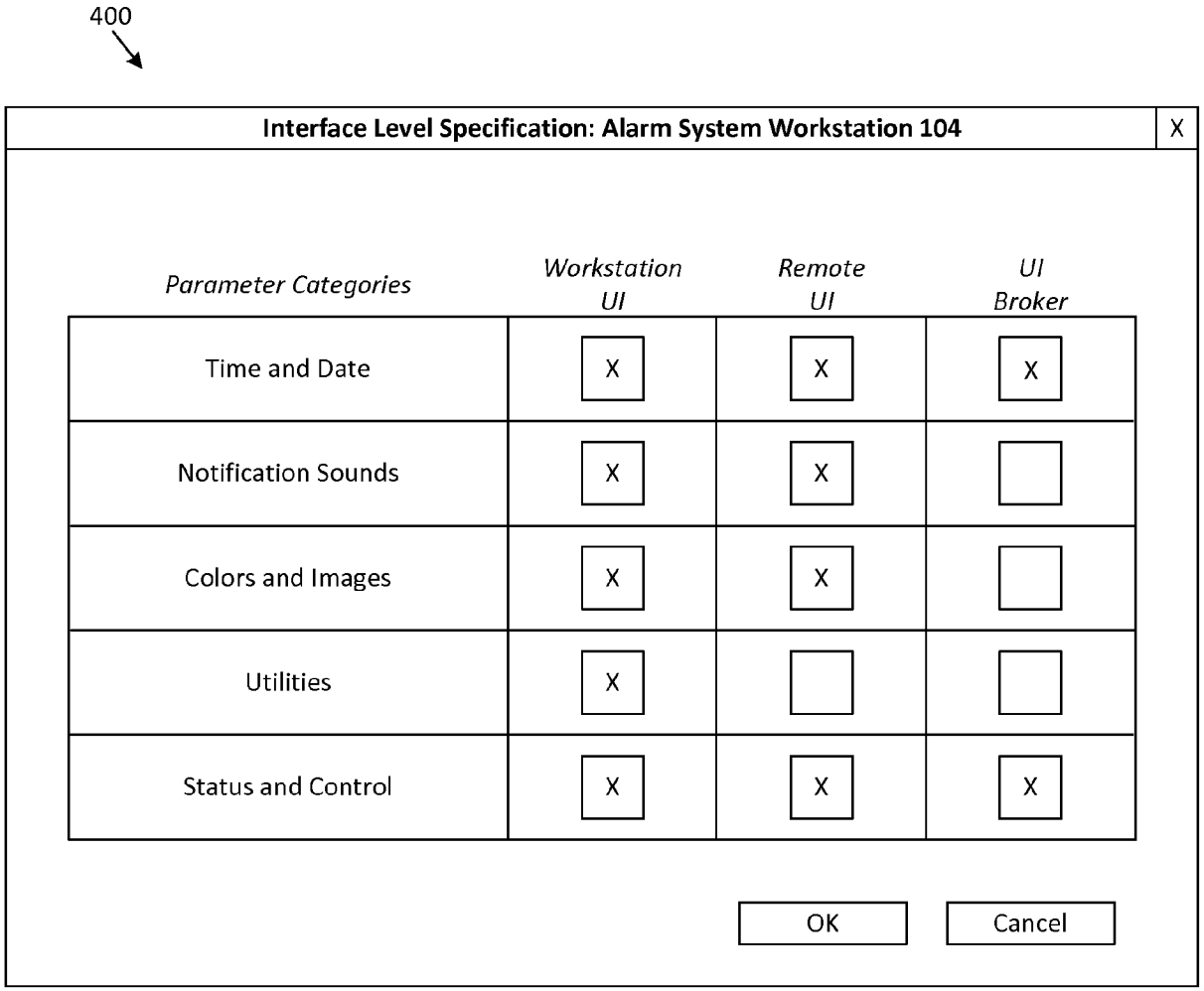
FIGS. 4-6 are screen shots illustrating exemplary configuration add-ons for configuration tools of alarm system workstations in accordance with the present disclosure.
Figure 5:
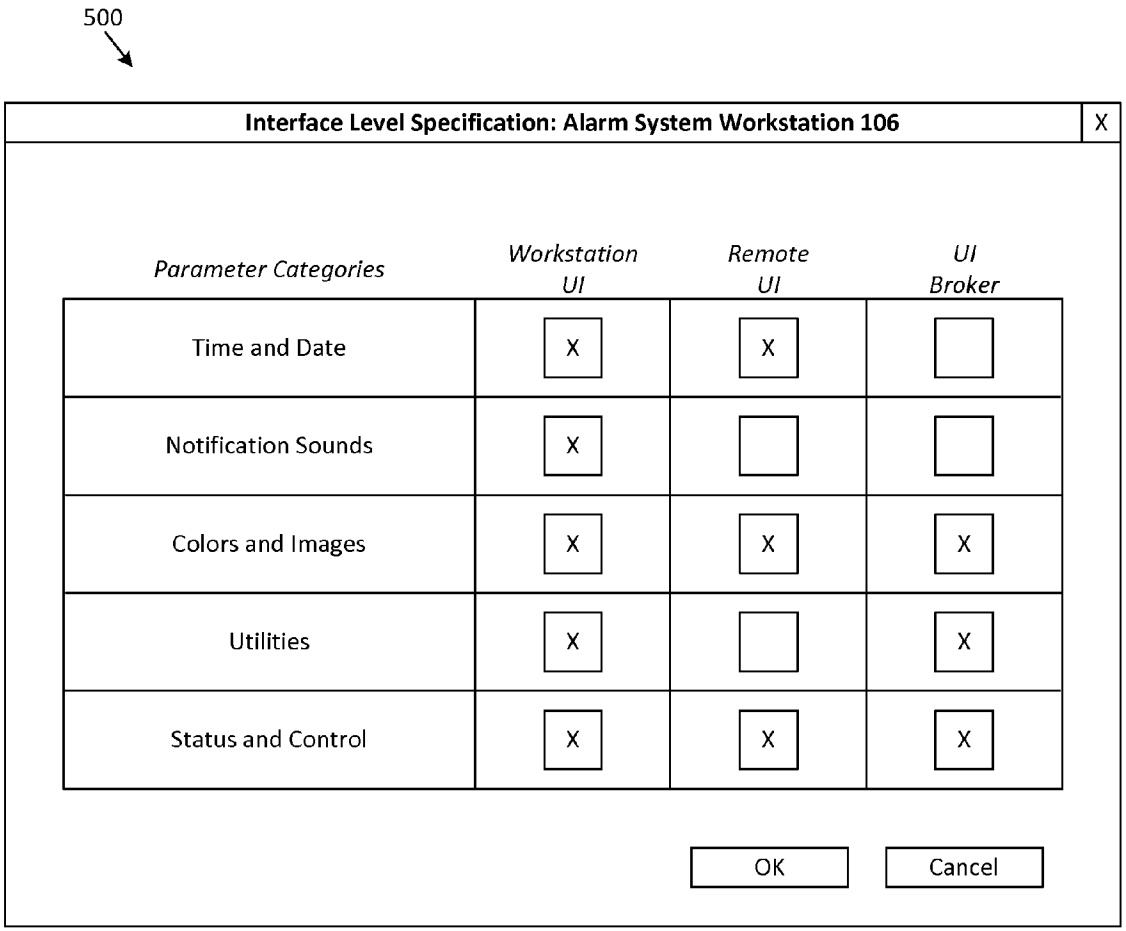
Figure 6:
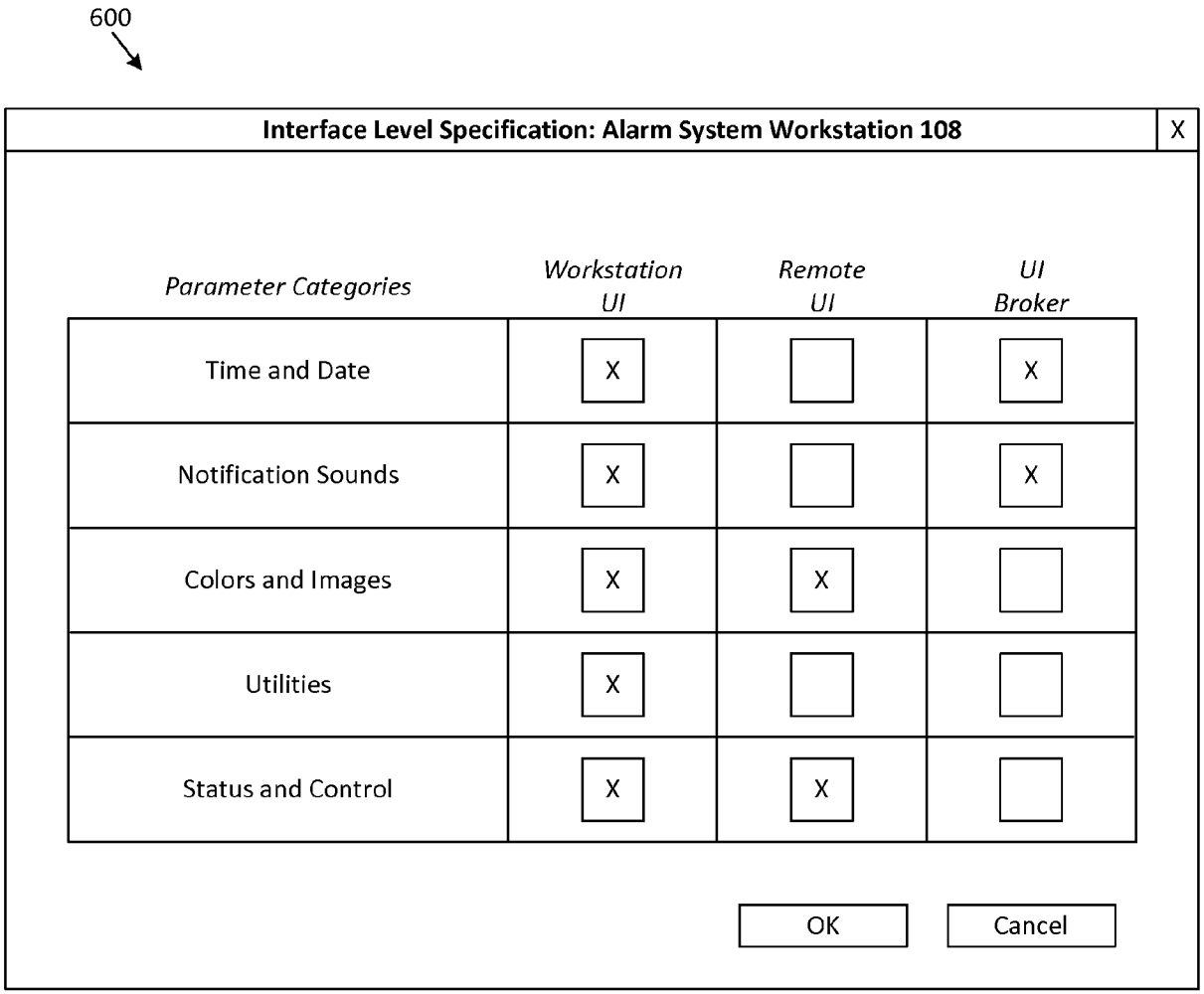

In order to facilitate the designation of different alarm system workstations for controlling different configuration parameters of the comprehensive UI, the UI applications of the alarm system workstations 104-108 may be provided with respective configuration add-ons 400, 500, and 600, exemplary screenshots of which are shown in FIGS. 4, 5, and 6, respectively. The configuration add-ons 400, 500, and 600 may be implemented as software extensions of the existing configuration tools of the UI applications of the alarm system workstations 104-108, for example.

Each of the configuration add-ons 400-600 may include a list of interface parameter categories, wherein each listed category is associated with one or more configuration parameters that may be specified using the existing configuration tool (not shown) of a respective alarm system workstation's UI application. As shown in FIGS. 4-6, such categories may include, but are not limited to, "Time and Date," "Notification Sounds," "Colors and Images," "Utilities," and "Status and Control." It will be appreciated that this list is merely exemplary, and that many other parameter categories may additionally or alternatively be implemented and listed in the configuration add-ons 400-600 without departing from the present disclosure.

Each of the configuration add-ons 400-600 may further include an arrangement for allowing an operator to specify one or more "interface levels" for each of the listed parameter categories. The interface levels may include a "Workstation UI" level, a "Remote UI" level, and a "UI Broker" level, for example. By selecting one or more of the interface levels for a particular parameter category, such as by clicking an appropriate box or field provided in the add-ons 400-600, an operator may specify that the configuration parameters associated with that category may be applied at the selected interface level(s). For example, referring to the screenshot of the configuration add-on 400 shown in FIG. 4, the "Workstation UI" level, "Remote UI" level, and "UI Broker" level are all selected for the "Time and Date" parameter category. Thus, the configuration parameters of the UI application of the alarm system workstation 104 relating to time and date may be applied to UIs presented at the alarm system workstation 104, a remote client workstation (not shown) that is directly connected to the alarm system workstation 104, and at the client workstations 124-128 that are connected to the alarm system workstation 104 via the UI broker. By contrast, the "UI Broker" level in the illustrated embodiment is not selected for the "Notification Sounds" parameter category. Thus, the configuration parameters of the UI application of the alarm system workstation 104 relating to notification sounds will not be applied to the comprehensive UI presented at the client workstations 124-128 via the UI broker.

Figure 7:
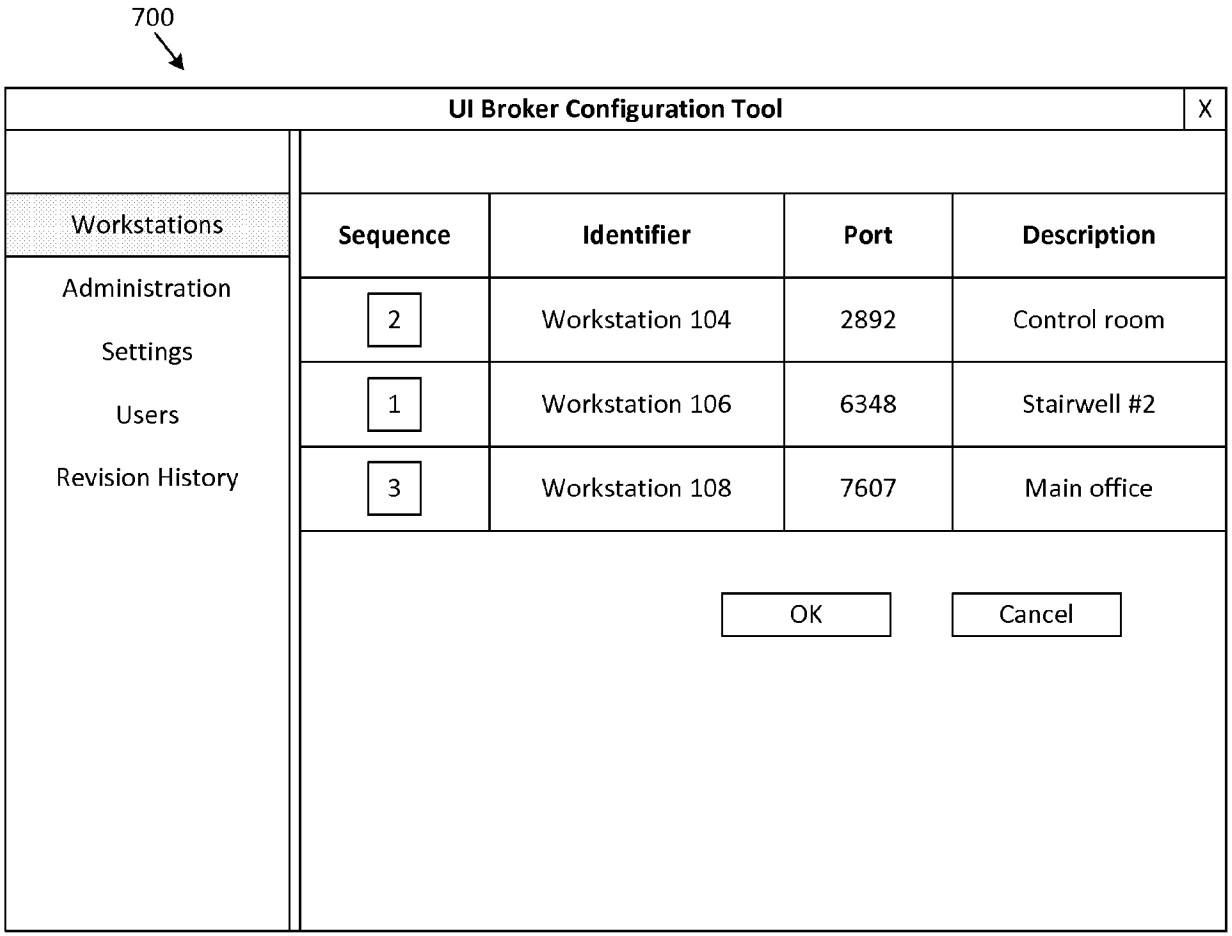
FIG. 7 is a screen shot illustrating an exemplary alternative configuration tool for a UI broker in accordance with the present disclosure.

It is possible that the same parameter category may be selected for application at the "UI broker" interface level in two or more of the configuration add-ons 400-600. For example, referring to FIGS. 4 and 6, the "Time and Date" parameter category is selected for application at the "UI broker" interface level in each of the configuration add-ons 400 and 600. It may therefore be necessary for the UI broker to determine whether the "Time and Date" parameters of the UI application of the alarm system workstation 104 or the alarm system workstation 108 should be applied to the comprehensive UI that is presented at the client workstations 124-128. To that end, the UI broker may be provided with an alternative configuration tool 700 (i.e., alternative to the configuration tool 200 described above), an exemplary screenshot of which is shown in FIG. 7.

The configuration tool 700 may be similar to the configuration tool 200 described above, and may include a list of the alarm system workstations 104-108 in the alarm system 102 that have been selected for interface via the UI broker. Such list may have been automatically or manually established upon previous initialization of the UI broker and may include some or all of the alarm system workstations 104-108 in the alarm system 102. The configuration tool 700 may further include an arrangement for allowing an operator to specify an ordered sequence of the listed alarm system workstations 104-108. For example, a numerical entry field may be provided adjacent each of the listed alarm system workstations 104-108 as shown in FIG. 7 for allowing an operator to manually enter a desired sequence number for each of the alarm system workstations 104-108. In another, non-pictured example, the top-to-bottom order in which the listed alarm system workstations 104-108 appear in the list may determine the ordered sequence, and an operator may be provided with the ability to drag-and-drop each of the listed alarm system workstations 104-108 at a desired position within the list. Of course, those of ordinary skill in the art will appreciate that many other means for specifying an ordered sequence of the listed alarm system workstations 104-108 may be implemented without departing from the present disclosure.

Thus arranged, when the UI broker presents the comprehensive UI at the client workstations 124-128, the UI broker may use the ordered sequence of the alarm system workstations 104-108 established in the configuration tool 700 to determine which configuration parameters should be applied to the comprehensive UI. For example, since the alarm system workstation 106 is designated as having the first position in the ordered sequence in the configuration tool 700, the UI broker will first determine whether any of the parameter categories in the configuration add-on 500 have been selected for application at the "UI Broker" interface level and will apply corresponding configuration parameters of the UI application of the alarm system workstation 106 to the comprehensive UI. Thus, since the "Colors and Images," "Utilities," and "Status and Control" parameter categories are selected for application at the "UI Broker" interface level in the configuration add-on 500, all of the configuration parameters relating to those categories in the UI application of the alarm system workstation 106 may be applied to the comprehensive UI.

However, since the "Time and Date" and "Notification Sounds" parameter categories are not selected for application at the "UI Broker" interface level in the configuration add-on 500, the configuration parameters relating to those categories in the UI application of the alarm system workstation 106 will not be applied to the comprehensive UI. Instead, the UI broker will proceed to the next alarm system workstation (i.e., alarm system workstation 104) in the ordered sequence in the configuration tool 700 and will determine whether any of the parameter categories that were not selected for application at the "UI Broker" interface level in the configuration add-on 500 are selected for such application in the configuration add-on 400 and will apply corresponding configuration parameters to the comprehensive UI. Thus, since the "Time and Date" parameter category is selected for application at the "UI Broker" interface level in the configuration add-on 400, all of the configuration parameters relating to time and date in the UI application of the alarm system workstation 104 may be applied to the comprehensive UI. It will be noted that even though the "Status and Control" parameter category is selected for application at the "UI Broker" interface level in the configuration add-on 400, such configuration parameters of the UI application of the alarm system workstation 104 will not be applied to the comprehensive UI because such configuration parameters were already derived from the UI application of the alarm system workstation 106, which precedes the alarm system workstation 104 in the ordered sequence in the configuration tool 700.

Since the "Notification Sounds" parameter category is not selected for application at the "UI Broker" interface level in the configuration add-on 400, the UI broker will proceed to the next alarm system workstation (i.e., alarm system workstation 108) in the ordered sequence in the configuration tool 700 and will determine whether that parameter category is selected for application at the "UI Broker" interface level in the configuration add-on 600 and will apply such configuration parameters to the comprehensive UI. Thus, since the "Notification Sounds" parameter category is selected for application at the "UI Broker" interface level in the configuration add-on 600, all of the configuration parameters relating to notification sounds in the UI application of the alarm system workstation 108 may be applied to the comprehensive UI.

Thus, the configuration tool 700 of the UI broker of the alarm system 102 may be used in conjunction with the configuration add-ons 400-600 to specify which of the alarm system workstations 104-108 are given priority in dictating certain configuration parameters of the comprehensive UI that is presented at the client workstations 124-128.

Figure 8:
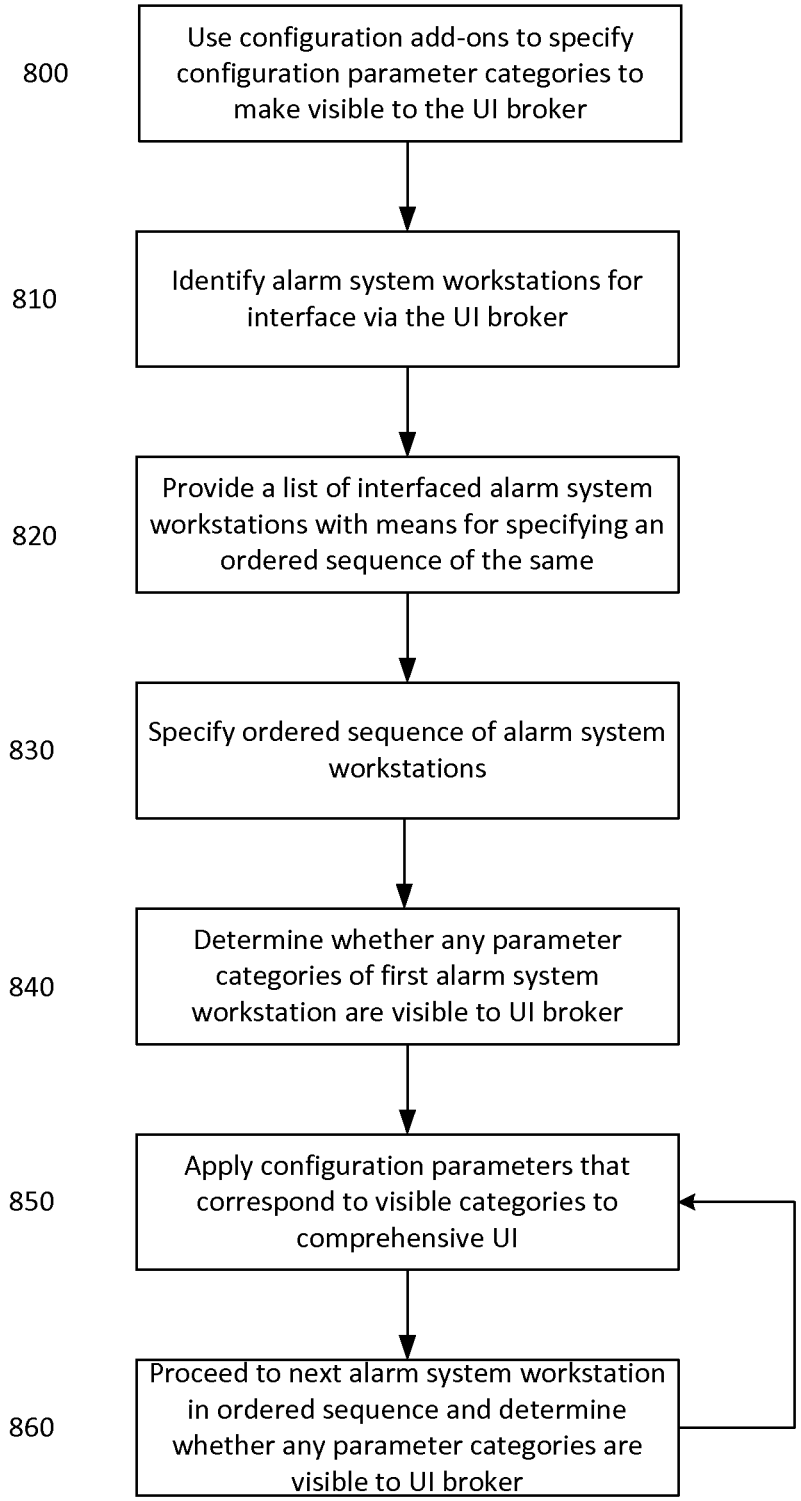
FIG. 8 is a flow diagram illustrating an exemplary alternative method for establishing configuration parameters for a comprehensive UI in accordance with the present disclosure.

Referring to FIG. 8, a flow diagram illustrating an exemplary method for implementing the above-described alternative configuration system in accordance with the present disclosure is shown. Such method will be described in conjunction with the schematic representation of the alarm system 102 shown in FIG. 1 and the exemplary screenshots of the configuration add-ons 400-600 and configuration tool 700 shown in FIGS. 4-7.

At step 800, an operator may use the configuration add-ons 400-600 of the of the interfaced alarm system workstations 104-108 to specify configuration parameter categories that may be made visible to the UI broker and possibly applied to the comprehensive UI presented at the client workstations 124-128.

At step 810, an operator may use the configuration tool 700 to identify two or more of the alarm system workstations 104-108 in the alarm system 102 to be made available for client interface via the UI broker. Such identification may be performed, for example, by inputting a computer identifier, TCP/IP port, and/or connection passcode for each desired alarm system workstation.

At step 820, an operator may open the configuration tool 700 of the UI broker, whereupon the operator may be presented with the list of previously-entered, interfaced alarm system workstations 104-108, along with an arrangement for specifying an ordered sequence of the listed alarm system workstations 104-108. The operator may, at step 830 of the exemplary method, use the provided specification arrangement to specify an ordered sequence of the listed alarm system workstations 104-108. For example, the operator may enter a desired sequence number into an appropriately-labeled box or field located adjacent each of the listed alarm system workstations 104-108 as shown in FIG. 7.

At step 840, the configuration tool 700 may determine whether any of the parameter categories in the configuration add-on of the first alarm system workstation in the ordered sequence in the configuration tool 700 are selected for application at the "UI Broker" interface level. The UI broker may, at step 850, apply all of the configuration parameters that correspond to such selected parameter categories to the comprehensive UI presented at the client workstations 124-128.

At step 860, the configuration tool 700 may proceed to the next alarm system workstation in the ordered sequence in the configuration tool 700 and may determine whether any of the parameter categories that were not established by the first (or preceding) alarm system workstation in the ordered sequence (i.e., not selected for application at the "UI Broker" interface level in the configuration add-on of the preceding alarm system workstation in the sequence) are selected for application at the "UI Broker" interface level in the configuration add-on of such next alarm system workstation. The UI broker may, at step 860, apply all of the configuration parameters that correspond to any such selected categories to the comprehensive UI presented at the client workstations 124-128.

Steps 850 and 860 may be repeated until all of the configuration parameters for the comprehensive UI presented at the client workstations 124-128 have been established.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The various embodiments or components described above, for example, the alarm system workstations, broker workstations, and the components or processors therein, may be implemented as part of one or more computer systems. Such a computer system may include a computer, an input device, a display unit and an interface, for example, for accessing the Internet. The computer may include a microprocessor. The microprocessor may be connected to a communication bus. The computer may also include memories. The memories may include Random Access Memory (RAM) and Read Only Memory (ROM). The computer system further may include a storage device, which may be a hard disk drive or a removable storage drive such as a floppy disk drive, optical disk drive, and the like. The storage device may also be other similar means for loading computer programs or other instructions into the computer system.

As used herein, the term "computer" may include any processor-based or microprocessor-based system including systems using microcontrollers, reduced instruction set circuits (RISCs), application specific integrated circuits (ASICs), logic circuits, and any other circuit or processor capable of executing the functions described herein. The above examples are exemplary only, and are thus not intended to limit in any way the definition and/or meaning of the term "computer."

The computer system executes a set of instructions that are stored in one or more storage elements, in order to process input data. The storage elements may also store data or other information as desired or needed. The storage element may be in the form of an information source or a physical memory element within the processing machine.

The set of instructions may include various commands that instruct the computer as a processing machine to perform specific operations such as the methods and processes of the various embodiments of the invention. The set of instructions may be in the form of a software program. The software may be in various forms such as system software or application software. Further, the software may be in the form of a collection of separate programs, a program module within a larger program or a portion of a program module. The software also may include modular programming in the form of object-oriented programming. The processing of input data by the processing machine may be in response to user commands, or in response to results of previous processing, or in response to a request made by another processing machine.

As used herein, the term "software" includes any computer program stored in memory for execution by a computer, such memory including RAM memory, ROM memory, EPROM memory, EEPROM memory, and non-volatile RAM (NVRAM) memory. The above memory types are exemplary only, and are thus not limiting as to the types of memory usable for storage of a computer program.

The invention claimed is:

1. A configuration system for establishing configuration parameters for a comprehensive user interface in an alarm system, the configuration system comprising:

a plurality of alarm system workstations connected to respective pluralities of alarm system points via respective alarm panels, each alarm system workstation having a set of appearance and operation configuration parameters associated therewith;

a client workstation; and a user interface broker operatively connected to each of the alarm system workstations and the client workstation;

a configuration tool, included in the user interface broker, displaying a list of select ones of each of the alarm system workstations associated with the user interface broker, the configuration tool designates one of the alarm system workstations as a main alarm system workstation such that the set of appearance and operation configuration parameters associated with the designated main workstation are applied to the comprehensive user interface in a manner that facilitates control over, monitoring and display of the pluralities of the alarm system points from the designated main alarm system workstation.

2. The configuration system in accordance with claim 1, wherein the set of appearance and operation configuration parameters associated with a first one of the plurality of alarm system workstations is different from the set of appearance and operation configuration parameters associated with a second one of the plurality of alarm system workstations.

3. The configuration system in accordance with claim 1, wherein the appearance and operation configuration parameters include at least one of the following, associated with main alarm system workstation, a notification sound, colors and images, the order and general configuration of particular screens, control buttons and menus that may be presented for monitoring the operation of each of the alarm system points.

4. The configuration system in accordance with claim 1, wherein the configuration tool resides on each of the alarm system workstations.

5. A method for establishing configuration parameters for a comprehensive user interface of an alarm system, the method comprising:

designating one of a plurality of alarm system workstations as a main workstation, the plurality of alarm system workstations connected to respective pluralities of alarm system points via respective alarm panels; and applying appearance and operation configuration parameters associated with the designated main workstation to the comprehensive user interface, whereby the comprehensive user interface facilitates control over, monitoring and display of, the pluralities of alarm system points from a client workstation.

6. The method in accordance with claim 5, further comprising:

identifying the plurality of alarm system workstations for interface via a user interface broker; and applying the appearance and operation configuration parameters to the comprehensive user interface via a configuration tool included in the user interface broker.

7. The method in accordance with claim 6, wherein the user interface broker aggregates data from the plurality of alarm system workstations for presentation via the comprehensive user interface.

8. The method in accordance with claim 5, wherein the appearance and operation configuration parameters include at least one of the following, associated with main alarm system workstation, a notification sound, colors and images, the order and general configuration of particular screens, control buttons and menus that may be presented for monitoring the operation of each of the alarm system points.

9. A configuration system for establishing configuration parameters for a comprehensive user interface of an alarm system, the configuration system comprising:

a plurality of alarm system workstations connected to respective pluralities of alarm system points via respective alarm panels, each alarm system workstation having a configuration add-on for facilitating selection of one or more categories of appearance and operation configuration parameters for application to the comprehensive user interface;

a client workstation;

a user interface broker operatively connected to each of the alarm system workstations and the client workstation, the user interface broker configured to aggregate data from the alarm system workstations and to enable specification of an ordered sequence of the alarm system workstations, wherein the ordered sequence is used by the user interface broker to determine which of the selected appearance and operation configuration parameter categories are applied to the comprehensive user interface; and a configuration tool, included in the user interface broker, displaying a list of select ones of each of the alarm system workstations associated with the user interface broker, the configuration tool designates one of the alarm system workstations as a main alarm system workstation such that the set of appearance and operation configuration parameters associated with the designated main workstation are applied to the comprehensive user interface in a manner that facilitates control over, monitoring and display of the pluralities of the alarm system points from the designated main alarm system workstation.

10. The configuration system in accordance with claim 9, wherein the user interface broker is configured to apply configuration parameters to the comprehensive user interface, wherein the applied configuration parameters are associated with the selected configuration parameter categories in the ordered sequence.

11. The configuration system in accordance with claim 10, wherein the user interface broker is configured to apply configuration parameters associated with the selected configuration parameter categories of subsequent alarm system workstations in the ordered sequence for configuration parameter categories that were not selected in the configuration add-on of the first alarm system workstation in the ordered sequence.

12. The configuration system in accordance with claim 9, wherein the user interface broker is configured to provide a list of the alarm system workstations connected thereto along with a tool for enabling an operator to specify an ordered sequence of the alarm system workstations.

13. The configuration system in accordance with claim 9 wherein the appearance and operation configuration parameters include at least one of the following, associated with main alarm system workstation, a notification sound, colors and images, the order and general configuration of particular screens, control buttons and menus that may be presented for monitoring the operation of each of the alarm system points.

14. A method for establishing configuration parameters for a comprehensive user interface of an alarm system, the method comprising:

selecting appearance and operation categories of configuration parameters at each of a plurality of alarm system workstations for application to the comprehensive user interface, the plurality of alarm system workstations connected to respective pluralities of alarm system points via respective alarm panels;

specifying an ordered sequence of the alarm system workstations;

using the ordered sequence of alarm system workstations to determine which of the selected appearance and operation configuration parameter categories are applied to the comprehensive user interface in a manner that facilitates control over, and monitoring of, the pluralities of alarm system points from a client workstation; and determining whether the appearance and operation configuration parameter categories of a first of the plurality of alarm system workstations in the ordered sequence are selected as being visible to a user interface broker and applying the appearance and operation configuration parameters associated with the selected categories to the user interface broker for all the alarm system workstations.

15. The method in accordance with claim 14, wherein the appearance and operation configuration parameter categories include at least one of the following, notification sounds, colors and images, the order and general configuration of particular screens, control buttons and menus that may be presented for monitoring the operation of each of the alarm system points associated with each alarm system workstation.

16. The method in accordance with claim 15, wherein the user interface broker aggregates data from the plurality of alarm system workstations for presentation via the comprehensive user interface.

17. The method in accordance with claim 14, further comprising providing a list of the alarm system workstations along with a tool for allowing an operator to specify an ordered sequence of the alarm system workstations.

18. The method in accordance with claim 14, wherein using the ordered sequence of alarm system workstations to determine which of the selected configuration parameter categories are applied to the comprehensive user interface comprises, for configuration parameter categories of the first alarm system workstation in the ordered sequence that were not selected for visibility to the user interface broker, determining whether any such configuration parameter categories of a subsequent alarm system workstation in the ordered sequence are selected for visibility to the user interface broker, and applying configuration parameters associated with the categories to the comprehensive user interface.

* * * * *